United States Patent [19]

Wallis

[11] Patent Number: 4,602,497

[45] Date of Patent: Jul. 29, 1986

[54] DIE CLAMPING ARRANGEMENT

[76] Inventor: Bernard J. Wallis, 25315 Kean Ave., Dearborn, Mich. 48124

[21] Appl. No.: 611,470

[22] Filed: May 17, 1984

Related U.S. Application Data

[63] Continuation-in-part of Ser. No. 575,497, Jan. 27, 1984, abandoned.

[51] Int. Cl.[4] ..... B21D 37/01

[52] U.S. Cl. ..... 72/462; 72/481; 269/235; 269/226; 269/152

[58] Field of Search ..... 72/481, 462, 482, 460; 269/91, 93, 238, 235, 226, 42, 111, 112, 153

[56] References Cited

U.S. PATENT DOCUMENTS

| | | | |
|---|---|---|---|
| 2,456,856 | 12/1948 | Bath | 72/462 |
| 2,482,708 | 9/1949 | Gordinier | 269/238 |
| 2,509,888 | 5/1950 | Schulz | 269/226 |
| 2,755,758 | 7/1956 | Johansen | 72/462 |
| 3,119,507 | 1/1964 | Burritt | 72/452 |
| 3,702,560 | 11/1972 | Weidel | 72/481 |
| 3,881,343 | 5/1975 | Ducate | 72/455 |
| 4,274,332 | 6/1981 | Nakamura | 72/448 |
| 4,408,522 | 10/1983 | Yamane | 72/446 |
| 4,500,081 | 2/1985 | Carossino | 269/93 |

FOREIGN PATENT DOCUMENTS

| | | | |
|---|---|---|---|
| 3105025 | 9/1982 | Fed. Rep. of Germany | 72/462 |
| 585599 | 11/1958 | Italy | 269/111 |

*Primary Examiner*—Francis S. Husar
*Assistant Examiner*—David B. Jones
*Attorney, Agent, or Firm*—Barnes Kisselle Raisch Choate Whittemore & Hulbert

[57] ABSTRACT

A die is clamped to the bolster plate of a press by means of clamps around the sides of the die. Each clamp is operated by a rotatable shaft which extends from the clamp to the front side of the press. The operating shafts for the clamps at the rear side of the die are disposed below the die.

11 Claims, 13 Drawing Figures

110
112
114
116
118
120
122
126
128
130
132
134
136
138
140
142
144
146
148
150
152
154
156
158
160
162
164
166
18
54
11

DIE CLAMPING ARRANGEMENT

This application is a continuation-in-part of applicant's prior application Ser. No. 06/575,497, filed Jan. 27, 1984, now abandoned.

This invention relates to a clamp arrangement for dies.

In recent years there has been an increasing tendency in the field of metal forming presses to reduce capital costs and the need for maintaining large inventories of workpieces by frequently changing dies in a press in order to produce many different workpieces in the same press. The savings resulting from these frequent changing of dies can be maximized only if the removal and replacement of dies can be accomplished quickly so as to minimize labor costs and the down time of the press. Standard practice usually requires the die to be bolted or otherwise clamped around its edges to the bolster and ram of the press. While bolts or clamps at the front side of the press (the side to which the operator has access) create no real problem with respect to removal and replacement of dies, the rear side and the opposite ends of the die are frequently obstructed by press automation equipment or other obstructions which prevent easy access to all sides of the die. While the problem of access to all sides of the die can be avoided to some extent by using fluid operated clamps, mechanically operated clamps are preferred because of their greater reliability.

The object of the present invention is to provide a mechanically-operated die clamping arrangement which permits placement of a die clamp anywhere around the periphery of a die while requiring access to only the front side of the press.

Another object of this invention resides in a die clamping arrangement wherein remotely located die clamps are manually operable by rotatable shafts which extend from each clamp to the front side of the press.

A further object of this invention resides in the provision of a die clamping arrangement which insures the die will be securely clamped in place in a manner unaffected by vibrations of the press or die.

Other objects, features and advantages of the present invention will become apparent from the following description and accompanying drawings, in which.

Figure 1:
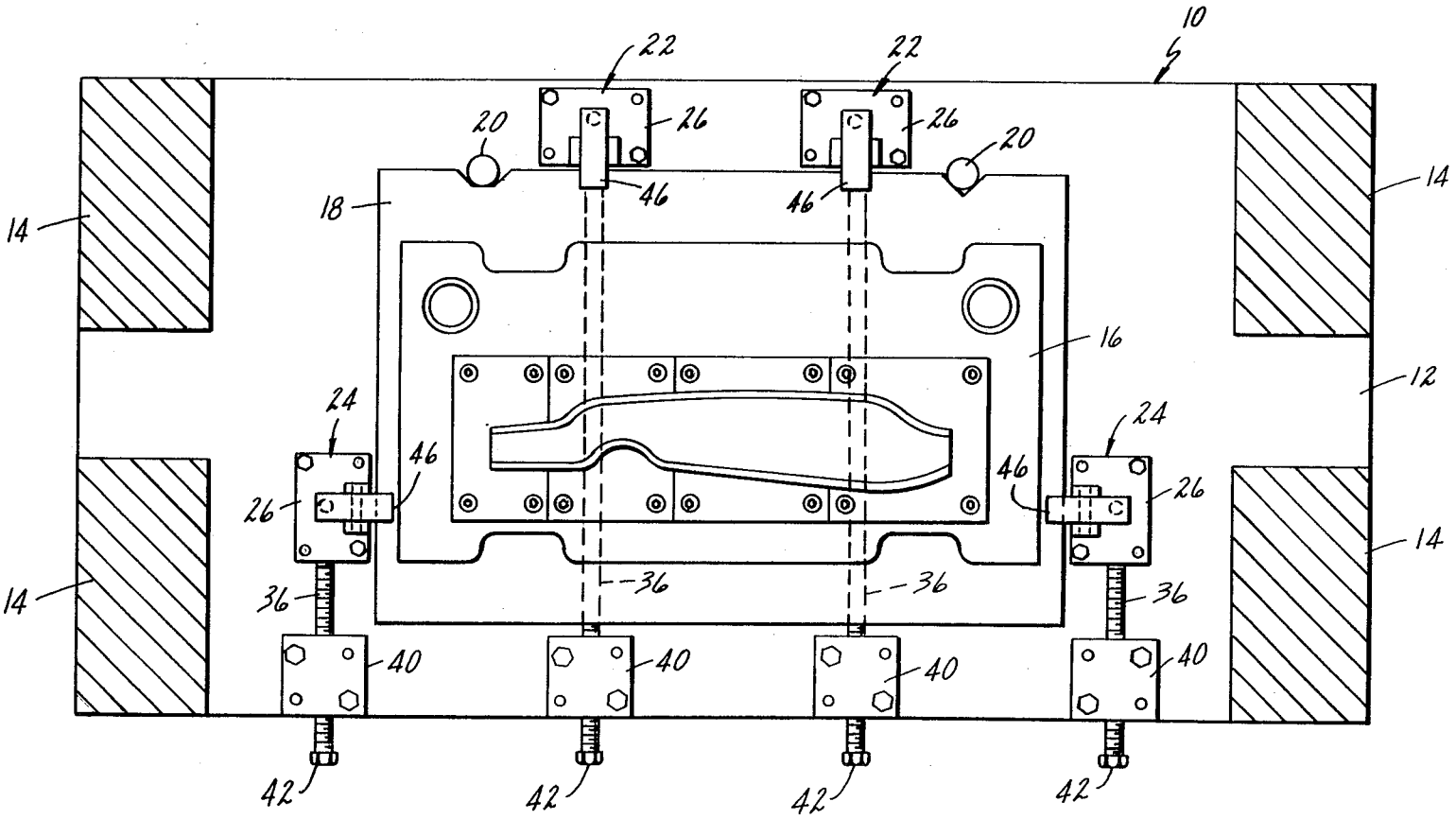
FIG. 1 is a plan view of a die clamping arrangement according to the present invention.
Figure 3:
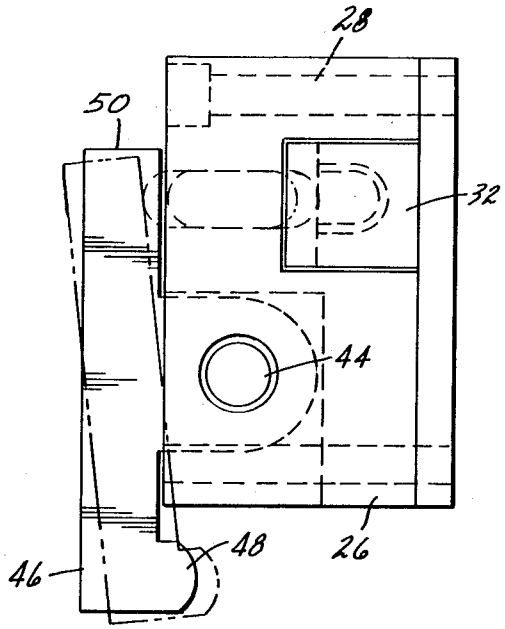
FIG. 3 is an end view of the clamp shown in FIG. 2.
Figure 2:
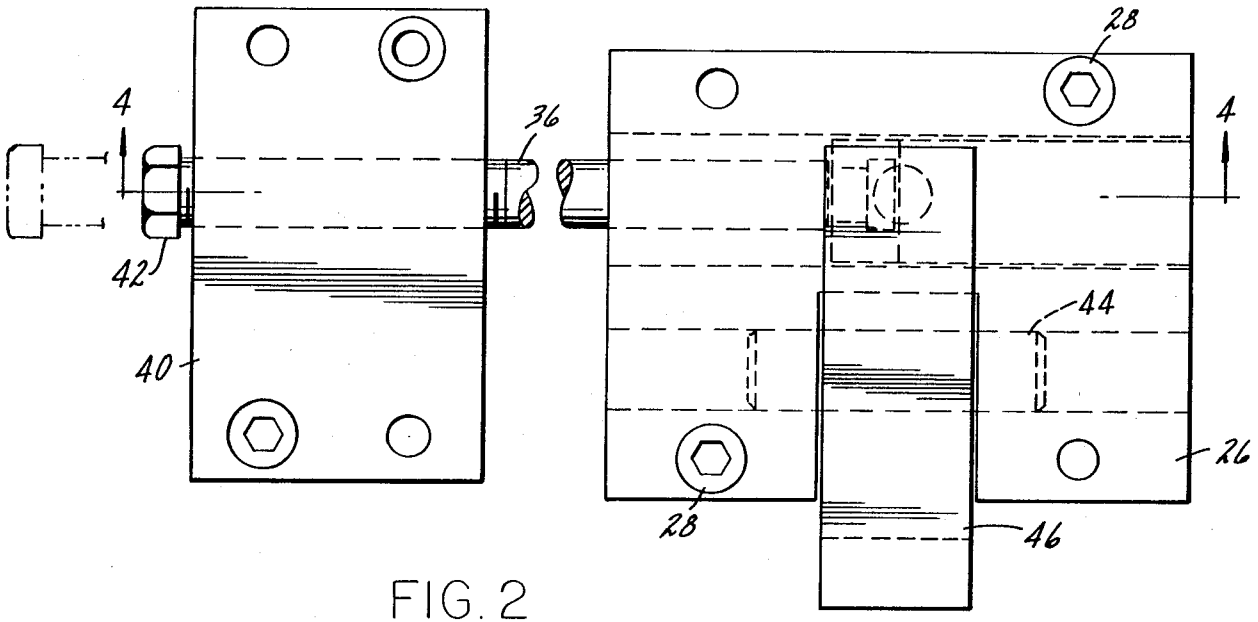
FIG. 2 is a plan view of one of the clamps.
Figure 4:
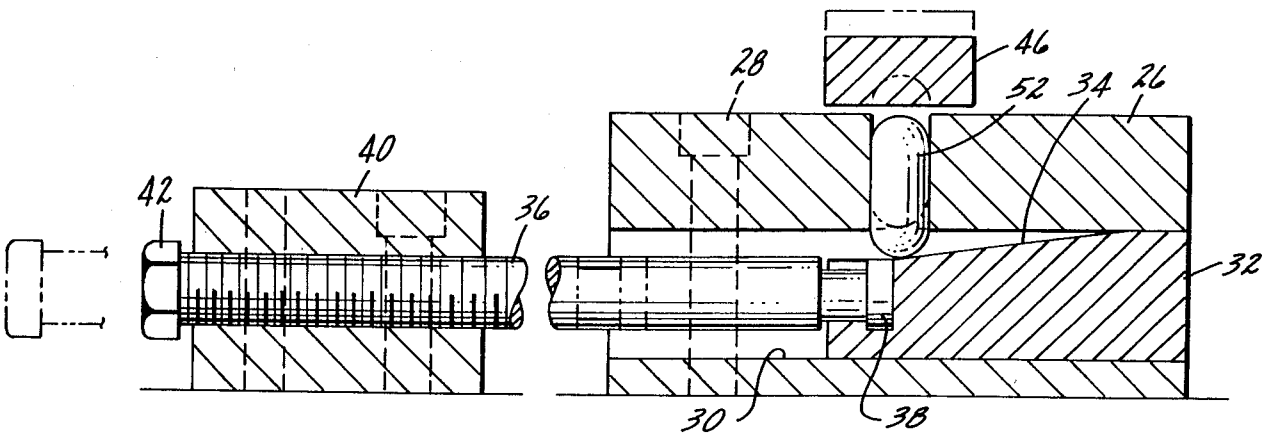
FIG. 4 is a sectional view taken along the line 4—4 in FIG. 2.
Figure 8:
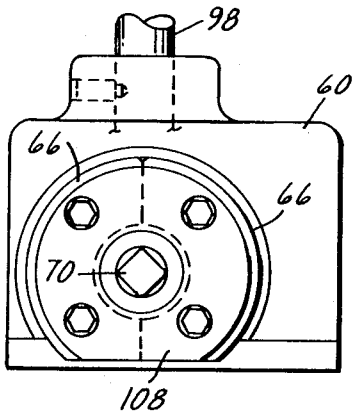
FIG. 8 is an end view of the clamp shown in FIG. 6.
Figure 5:
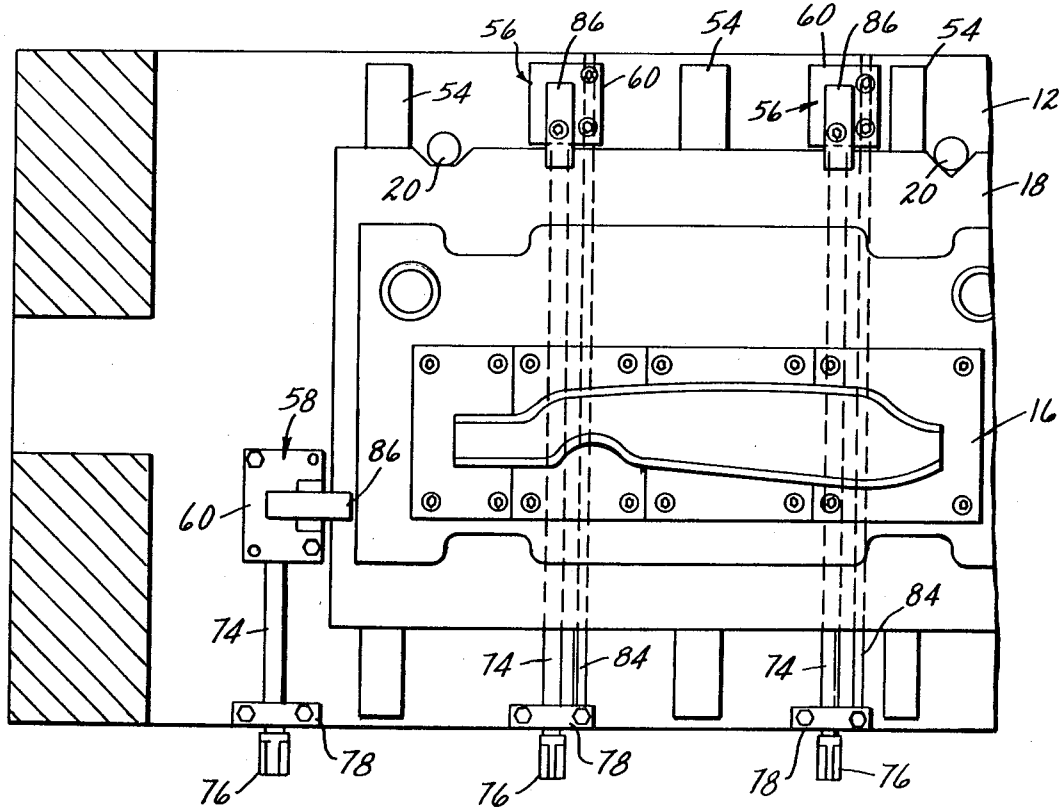
FIG. 5 is a plan view of another form of die clamping arrangement according to the present invention.
Figure 6:
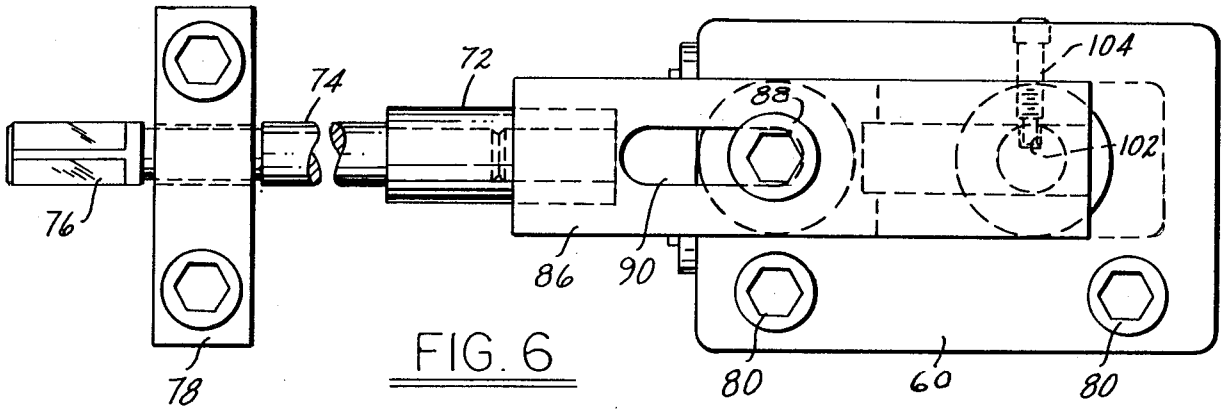
FIG. 6 is a plan view of one of the clamps shown in FIG. 5.
Figure 7:
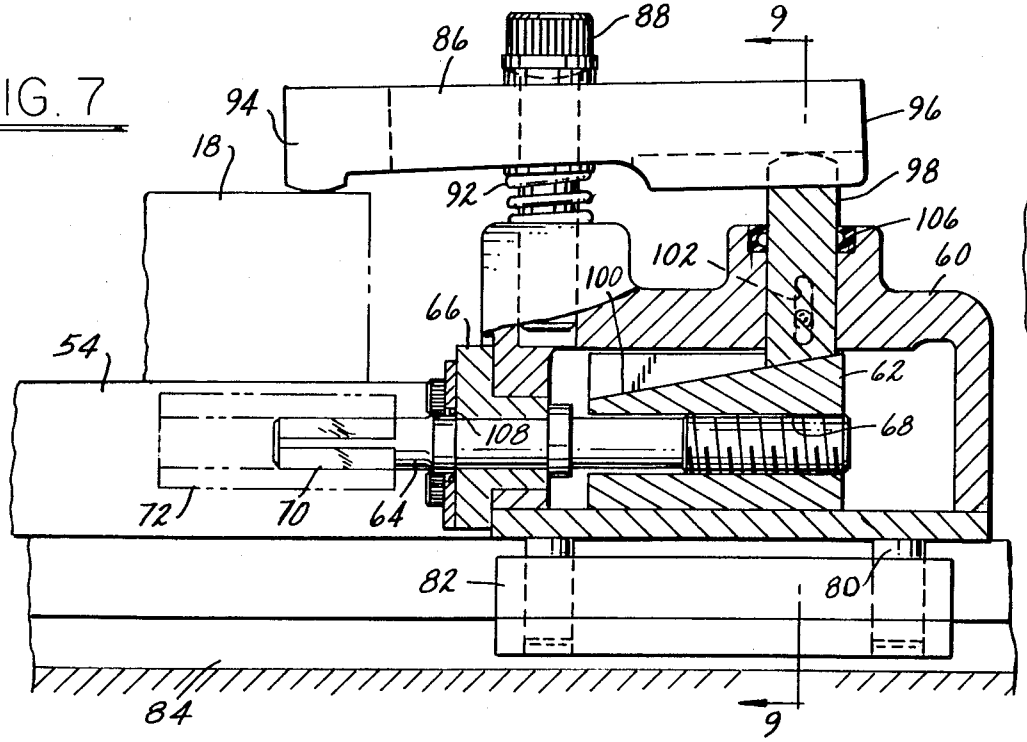
FIG. 7 is a side elevational view, partly in section, of the clamp shown in FIG. 6.
Figure 9:
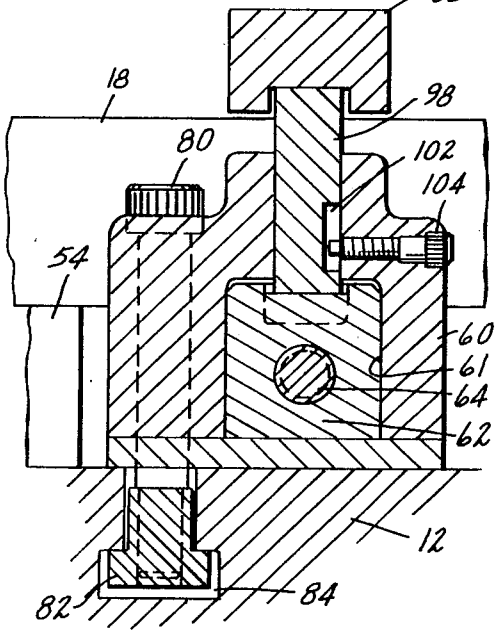
FIG. 9 is a sectional view along the line 9—9 in FIG. 7.

In FIG. 1 there is illustrated a press 10 having a bolster plate 12 and upright supports 14 at the four corners of the bolster plate 12. A lower die 16 is securely mounted on a bottom die plate 18 which is in turn supported on bolster plate 12 and located thereon in the proper position by means of locating pins 20. The die is firmly clamped onto bolster plate 12 by a plurality of clamps. In the illustrated embodiment two clamps 22 are located at the rear side of the die and one clamp 24 is shown arranged at each end of the die. Normally one or more clamps would be arranged along the front side of the die as well.

Each clamp 22,24 includes a housing 26 securely mounted on bolster plate 12 by means of screws 28. Each housing 26 is formed with a rectilinear guideway 30 which extends in a direction fore and aft of the die. Within guideway 30 there is arranged a sliding wedge block 32 having an upper face 34 inclined to the horizontal at a wedging angle. A screw 36 has one end thereof rotatably connected with wedge block 32 as at 38. The other end of each screw is threaded through a support bracket 40 bolted to bolster plate 12 adjacent the front side of the die, screws 36 extend freely through clearance openings in die plate 18. Each screw is formed with a noncircular head 42 so that it can be rotated in opposite directions with a wrench or other hand tool to advance or retract the screw.

On each housing 26 there is pivotally supported as at 44 a clamping lever 46. One end portion 48 of each clamping lever 46 overhangs the side of housing 26 which is adjacent the die. The other end portion 50 of each lever 46 overlies the inclined upper face 34 of wedge block 32. A plunger 52 mounted for vertical sliding movement in each housing 26 is arranged between the end portion 50 of lever 46 and the inclined upper face 34 of the wedge block.

With the above described arrangement it will be appreciated that, when screw 36 is rotated to retract it through bracket 40, the wedge block 32 is displaced in a direction toward bracket 40 and plunger 52 is shifted upwardly to rock clamping lever 46 in a direction which causes the end portion 48 to pivot downwardly into clamping engagement with die plate 18. The clamp can be released by simply rotating screw 36 to advance it through the bracket 40.

The arrangement shown in FIGS. 5 thru 9 differs slightly from the arrangement previously described. In this arrangement there is interposed between bolster plate 12 and die plate 18 a plurality of parallel bars 54 which extend in a fore and aft direction beneath the die plate and support it in an elevated position relative to the bolster plate. Likewise, in this arrangement the clamps 56 at the rear side of the die and the clamps 58 (only one of which is shown) at each end of the die are constructed slightly different from the clamps previously described. Each of these clamps includes a housing 60 having a guideway 61 in which a wedge block 62 is slideably arranged for displacement in a direction fore and aft of the die. A stub shaft 64 is rotatably supported in housing 60 by means of a vertically split bushing 66. The inner end of shaft 64 is threaded into wedge block 62 as at 68. When the shaft is rotated in opposite directions wedge block 62 is caused to slide back and forth within the housing.

The outer end of shaft 64 has a noncircular end portion 70 which is connected as by a coupling 72 with the noncircular rear end of a shaft 74 which extends forwardly over bolster plate 12. The noncircular front end 76 of shafts 74 overhang the front edge of bolster plate 12 and are rotatably supported in axially fixed position by brackets 78 bolted to the bolster plate. Housings 60 are secured to bolster plate 12 by bolts 80 which extend downwardly through the housings and are threaded into T nuts 82 arranged in T slots 84 in the top face of the bolster plate.

A clamping lever 86 is rockably supported on each housing 60 by means of a screw 88 which extends downwardly through a centrally slotted portion 90 in each clamp lever 86. A compression spring 92 is arranged between clamp lever 86 and the top of housing 60. As in the previous embodiment described, one end 94 of each lever 86 overhangs the side of housing 60 which is adjacent the die. The opposite end 96 of each lever 86 bears against the upper end of a plunger 98 which is vertically slideable in housing 60 and has its lower end engaging the upper inclined wedging surface 100 of wedge block 62. Plunger 98 is prevented from rotating by means of a vertical slot 102 in the plunger which is engaged by the end of a dog screw 104. The periphery of plunger 98 is sealed with respect to housing 60 by a sealing ring 106 and shaft 64 is sealed within split bushing 66 by a sealing ring 108 clamped to the outer face of bushing 66.

In operation the clamp arrangement shown in FIGS. 5 thru 9 differs from that shown in FIGS. 1 thru 4 primarily in that the rotatable shafts 74 are axially fixed and the threaded engagement at 68 between shafts 64 and wedge blocks 62 cause the wedge blocks to be shifted in response to rotation of the shafts. In both arrangements it will be appreciated that, regardless of their location around the side of the die, the clamps are readily accessible for operation from the front side of the press. Thus, the dies can be placed into and removed from a press with a minimum of time and effort. It will also be appreciated that the same types of clamps can be used for clamping the upper die to the ram of the press if desired.

Figures 10, 11, 12, 13:
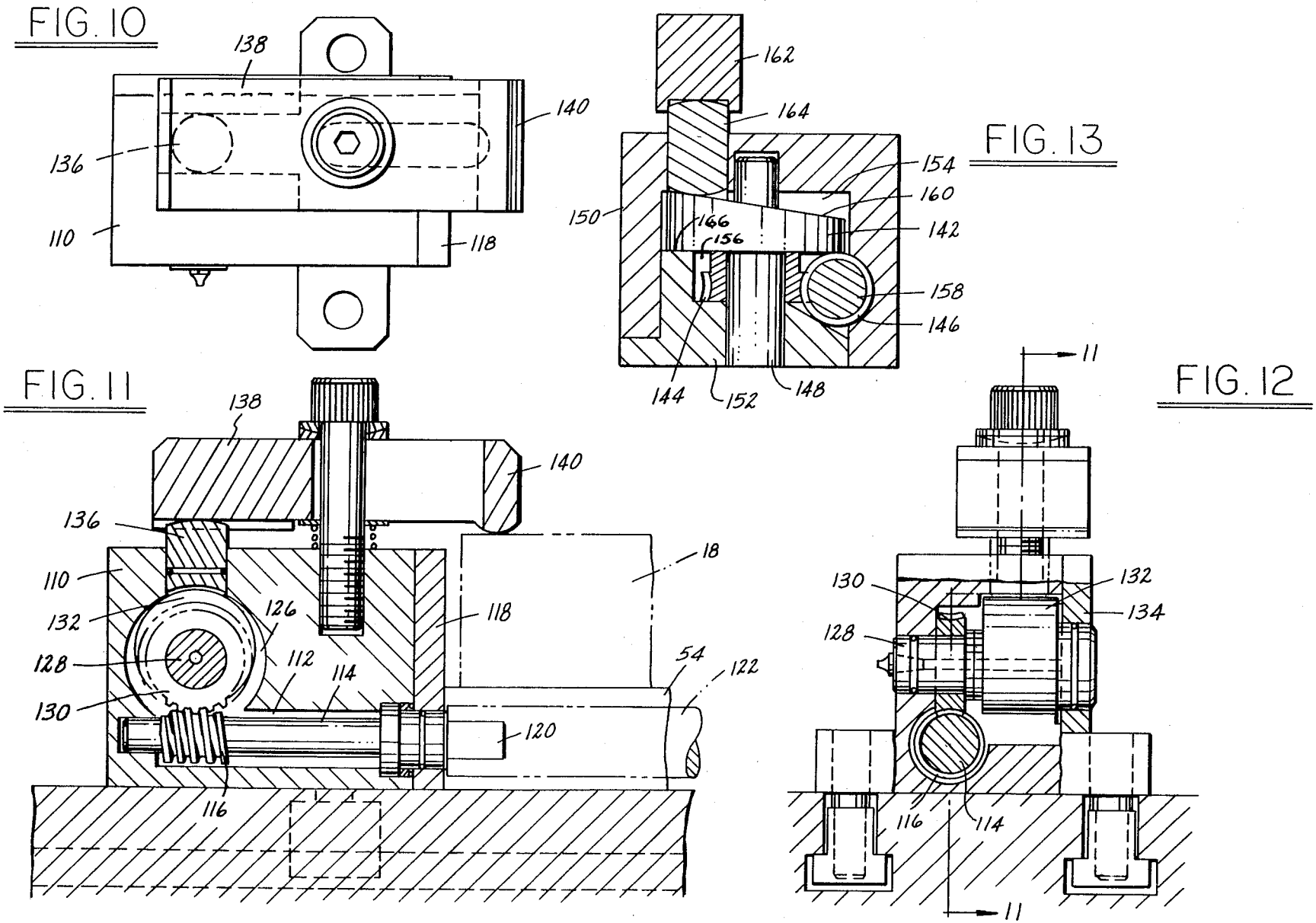
FIG. 10 is a top plan view of another clamp according to the present invention.
FIG. 11 is a vertical sectional view of the clamp taken along the line 11—11 in FIG. 12.
FIG. 12 is an end view of the clamp partly in section.
FIG. 13 is a view similar to FIG. 12 and showing another form of clamp according to the present invention.

The clamp illustrated in FIGS. 10 thru 12 differs only slightly from the clamps previously described. In this arrangement the clamp housing 110 is formed with a bore 112 in which a shaft 114 is journalled. The inner end portion of shaft 114 supports a worm gear 116 to rotate therewith. The outer end portion of shaft 114 is journalled in a cover plate 118 and has a noncircular end portion 120 which is adapted to be coupled to the rear end of a shaft 122 which extends forwardly from the rear side of the press to the front side thereof and under the die plate 18 which is supported on the parallel bars 54. Within a cross bore 126 in housing 110 there is journalled a second shaft 128 on which is fixed a worm wheel 130 in mesh with worm gear 116. There is also fixedly mounted on shaft 128 an eccentric cam 132. The end of shaft 128 opposite worm wheel 130 is journalled in a cover plate 134. A vertical plunger 136 has its lower inner end engaging the periphery of cam 132 and its upper end engaging clamp lever 138. Clamp lever 138 is similar in all important respects to the clamp levers previously described and arranged so that when the clamp lever is rocked in a clockwise direction as viewed in FIG. 11 its distal end 140 bears downwardly upon die 124 at the rear edge thereof.

The clamp arrangement shown in FIGS. 10 thru 12 can be manufactured more economically than those previously described and still provides a very clamping action on the die which is not apt to become loosened as a result of any vibrations or shocks applied to the press or the die. The firm gripping action can be attributed to the use of the worm gear and worm wheel 116,130, respectively, which have a relatively low pitch and to the cam 132. Cam 132 is actually a cylindrical member which is eccentric to the axis of shaft 128.

The clamp arrangement shown in FIG. 13 is similar in many respects to that shown in FIGS. 10 thru 12 in that it employs a worm and a worm gear for rotating a cam which rocks the clamping lever. However, this form differs from the previous form described in that the cam employed, designated 142, is a face cam rather than a cylindrical cam. Cam 142 is keyed to or otherwise fixedly connected to the worm wheel 144 which meshes with the worm gear 146 in substantially the same manner as described above in connection with the form of clamp illustrated in FIGS. 10 thru 12. Cam 142 and worm wheel 144 are mounted on an upright shaft 148.

The housing of the clamp comprises two housing members 150,152 which are assembled and secured together in any suitable manner. Housing member 150 is formed with a cylindrical cavity 154 for accommodating cam 142. Housing member 152 is formed with a cylindrical cavity 156 for accommodating worm wheel 144. Both housing members are bored as illustrated to accommodate the worm gear 146 and the shaft 158 on which the worm gear is formed.

As shown in FIG. 13 the cam face 160 of cam 142 is inclined to the horizontal and, when the cam is rotated, the clamp lever 162 is rocked on its supporting screw by vertical displacement of plunger 164 in a manner the same as described with respect to the previous embodiments. However, it will be noted that the portion of cavity 154 directly below plunger 164 is formed with a flat face 166 on which the adjacent flat portion of cam 142 is seated. Thus, as the cam 142 is rotated in a direction to rock the lever 162 to the locking position with the die plate, the vertical reaction force on cam 142 is applied directly to shoulder 166 and therefore does not tend to distort the cam or the shaft 148 on which it is mounted. It therefore follows that a very high clamping force can be exerted by the rocking lever 162 on the die plate.

I claim:

1. In a press having a base plate and a die supported thereon, said press having a front side for access by the operator of the press and a rear side opposite and generally not accessible from said front side, means for clamping the die firmly against the base plate comprising a clamp mounted on said base between opposite ends of the die at the rear side of the press, said clamp including a clamp lever, a displaceable cam for rocking the clamp lever to die clamping and die releasing positions, means for displacing the cam comprising a rotatable shaft extending below the die rearwardly from the front side of said base plate to said clamp at the rear side of the press, said shaft being operably connected at its rear end with said cam to displace the cam and thereby rock said lever between said positions when the shaft is rotated in opposite directions, and means at the front end of the shaft for manually rotating it and thereby operating said clamp at the rear side of the press, said clamp including a housing, a second shaft in said housing, said cam being mounted on said second shaft for rotation in said housing, said second shaft having a worm wheel thereon, said rotatable shaft having a worm gear thereon meshing with said worm wheel.

2. A press as called for in claim 1 including a plunger extending vertically between said clamp lever and said cam.

3. A press as called for in claim 2 wherein the pitch of the threads of the worm gear and worm wheel and the rise on the cam are sufficiently small as to prevent retrograde movement of the clamp lever in the absence of manual rotation of the rotatable shaft in a direction to loosen the clamp.

4. A press as called for in claim 2 wherein said cam comprises a circular cylindrical member mounted eccentrically on said second shaft, said plunger engaging the periphery of said cylindrical member.

5. A press as called for in claim 2 wherein said second shaft extends vertically, said cam comprising a disc having an upper face inclined at an acute angle to the axis of the second shaft, said plunger engaging the upper face of the cam.

6. A press as called for in claim 5 wherein the bottom face of the cam lies in a plane perpendicular to the axis of the second shaft, said housing having an upwardly facing shoulder therein aligned axially with said plunger and on which the bottom face of the cam is seated.

7. In a press having a base plate and a die supported thereon, means for clamping the die firmly against the base plate comprising a clamp assembly mounted on said base plate, said clamp assembly including a housing, said housing having a pair of bores therein the axes of which are perpendicularly related and spaced vertically apart, a first shaft journalled in one of said bores and extending outwardly through the housing, the outer end of said shaft being noncircular and adapted to be engaged by a tool for rotating the shaft, said shaft having a worm gear fixed thereon, a second shaft journalled in the other bore, said second shaft having a worm wheel thereon meshing with the worm gear on the first shaft, said second shaft also having a cam thereon fixed to said worm wheel, said housing having a vertical bore therein aligned with said cam, a plunger in said vertical bore having its lower end engaging the cam, a clamp lever mounted on said housing for rocking movement in a vertical plane, one end of said lever being engaged by the upper end of said plunger and adapted to be shifted vertically in response to rotation of said cam and the opposite end of said lever being adapted to engage and clamp downwardly firmly against a die supported on the base plate of the press.

8. A press as called for in claim 7 including an end plate on the face of the housing through which the first-mentioned shaft projects, said end plate forming an end wall for the first bore and having an opening therein in which the outwardly projecting end of the first-mentioned shaft is journalled.

9. A press as called for in claim 7 wherein said cam comprises a cylindrical member eccentrically mounted on said second shaft.

10. A press as called for in claim 7 wherein the second shaft extends vertically in said housing, said cam comprising a disc the upper face of which is inclined at an acute angle to the axis of the second shaft.

11. A press as called for in claim 10 wherein the bottom face of the cam lies in a plane perpendicular to the plane of the axis of the second shaft, the second bore having an upwardly facing shoulder therein aligned vertically with said plunger and on which the bottom face of the cam is seated.

* * * * *